US005193260A

United States Patent [19]

Pierce

[11] Patent Number: 5,193,260

[45] Date of Patent: Mar. 16, 1993

[54] PIN EXTRACTING DEVICE

[75] Inventor: Edward C. Pierce, Swarthmore, Pa.

[73] Assignee: The Boeing Company, Seattle, Wash.

[21] Appl. No.: 784,322

[22] Filed: Oct. 31, 1991

[51] Int. Cl.[5] ..... B25B 19/00

[52] U.S. Cl. ..... 29/426.5; 29/254; 29/283.5; 140/106

[58] Field of Search ..... 29/275-277, 29/259, 426.5, 263, 282, 283.5, 254, 255, 283.5; 254/29 A; 140/106

[56] References Cited

U.S. PATENT DOCUMENTS

| | | | |
|---|---|---|---|
| 2,965,356 | 12/1960 | Cheskin | 254/29 A |
| 3,529,497 | 5/1984 | Brooks . | |
| 4,450,736 | 9/1970 | Kopnicky . | |
| 4,669,341 | 6/1987 | Small . | |
| 4,745,671 | 5/1988 | Shannon | 29/254 |

*Primary Examiner*—Robert C. Watson

*Attorney, Agent, or Firm*—Jones, Tullar & Cooper

[57] ABSTRACT

A device for extracting pins from an assembly by forcing the end of the pin into a swaging member, deforming the pin and firmly gripping it in the device. An impact force is then applied to the device to remove the pin from the assembly.

7 Claims, 1 Drawing Sheet

PIN EXTRACTING DEVICE

This invention relates in general to devices for extracting a part from a mechanical assembly and in particular where extraction will require a substantial amount of force due to corrosion or extremely tight fitting assemblies.

The removal of pins in a mechanical assembly is often complicated by the fact that only a small portion of the pin is available outside the assembly making it difficult to retain a grip on the pin and having sufficient frictional force to cause the pin to release from the assembly. Additionally, if the original assembly has become corroded, removal is made even more difficult. Often, if such a pin cannot be removed it becomes necessary to cut away a portion of the assembly and replace it with new parts, therefor increasing the cost of pin replacement. For example, in the renovation of aircraft that have been in service for some time, the removal of hinge pins is often a difficult process and if the pins cannot be removed, the hinge must be cut off and the aircraft structure must be repaired and an entire new hinge assembly installed.

The prior art devices, such as that shown in U.S. Pat. No. 4,669,341, rely on a frictional grip to remove the pin. When the removal force is high, a friction grip will not hold the pin for removal. It is therefor desirable to obtain a device that will provide a strong positive grip on a pin to be removed and maintain that grip under high impact removal forces.

SUMMARY OF THE INVENTION

A pin extraction device is described that provides a means for gripping a pin to be extracted by deforming the pin within the extraction tool such that the pin cannot slip from the tool. A hollow housing is provided which contains a swaging member inside the housing. The exposed end of the pin to be removed is inserted into the swaging member in the housing and the swaging member is forced onto the pin by threading a handle into the housing and forcing the pin into the swaging member where it is deformed and held firmly. The removal force can then be applied. To enhance the removal, an impact hammer can be applied to the handle to remove the pin.

DETAILED DESCRIPTION OF THE PREFERRED EMBODIMENT

Figure 1:
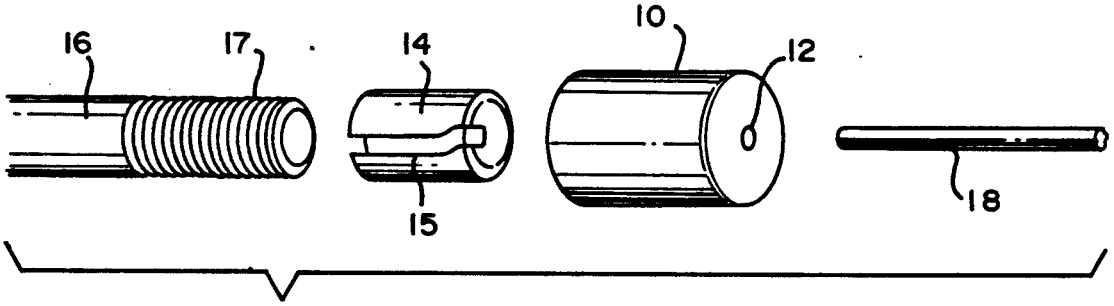
FIG. 1 is an exploded view of the device and a portion of a pin to be removed.

Referring now to FIG. 1, there is shown an exploded view of the device. A housing 10 is provided with a pin insertion hole 12 in its outer end. The swaging member 14 has an irregular opening 15 in its outer surface to receive the end of the pin 18. The handle member 16 has a threaded portion 17 which may be attached to the body 10 as shown in greater detail in FIG. 2.

Figure 2:
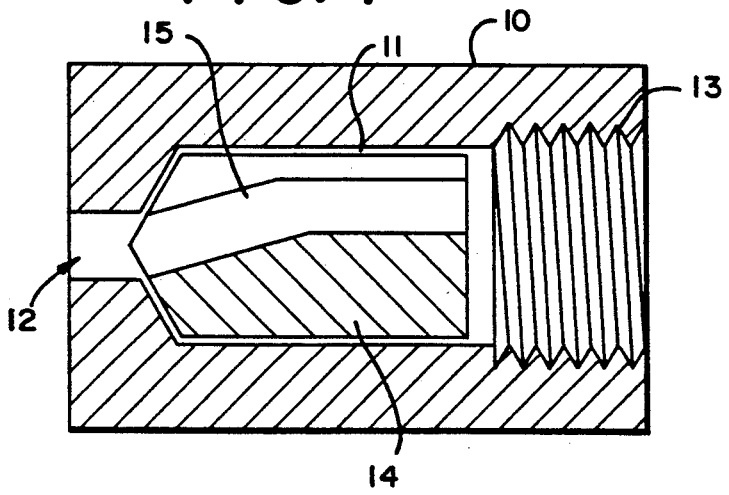
FIG. 2 is a sectional view of the housing and swaging member assembly.

Referring now to FIG. 2, there is shown a sectional view of the swaging member and housing assembly. The housing 10 is provided with a cavity 11 extending nearly through the housing. The pin receiving opening 12 is at the other end. The upper end of the cavity 11 is threaded as shown at 13 to receive the threaded portion 17 of the handle 16. The opening 15 in the surface of the swaging member 14 begins at the center of the opening 12 in the housing and then curves off the center line of the swaging member to form an irregular opening for deforming the pin.

Figure 3:
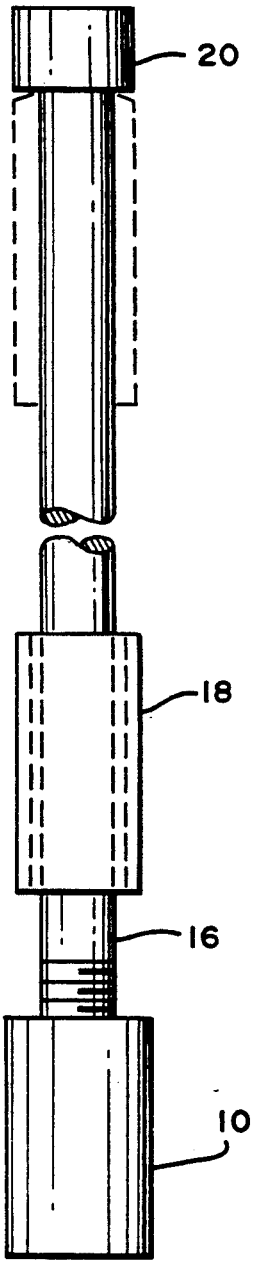
FIG. 3 is an assembly drawing of the device with an impact tool attached.

In FIG. 3 there is shown an assembly drawing of the device including an impact member 18 which is slidably mounted on the handle 16. The handle 16 is provided with a stop member 20 at the extreme end thereof. Such impact members are commonly referred to as "slap hammers" since the impact member 18 is "slapped" against the stop 20 to provide the extraction force in the operation of the device.

In operation, the exposed end of the pin 18 in inserted in the pin receiving hole 12 and started into the opening 15 in the swaging member. The handle 6 is then screwed into the housing by means of threads 17 and 13. As the handle end contacts the upper end of the swaging member, the pin is forced further into the opening 15 and is deformed into the irregular shape of the opening 15. The pin is thus firmly gripped in the housing by the swaging member. The impact member 18 is then "slapped" against the stop 20 applying a sharp extraction force on the pin.

Thus it can be seen that this invention provides simple pin extraction device using readily available components which can quickly extract pins from a mechanical assembly without cutting or otherwise damaging the remaining parts of the assembly.

What is claimed is:

1. A pin extracting device comprising:

a housing, said housing having a central bore extending therethrough and a counterbore extending from one end nearly through said housing, said central bore terminating in a pin-receiving opening at the other end of said housing;

a swaging body inserted in the counterbore of said housing, said swaging body having an irregular opening extending from the center along the length of the swaging body;

handle means inserted in said housing for activating said swaging body and for applying an extraction force to the device, said handle means fastened to said housing by means of threads in said housing and on said handle, said handle means activating said swaging body by forcing said swaging body into the counterbore of the housing when threaded into said housing.

2. The pin extracting device according to claim 1 wherein the pin extracting force is an impact force.

3. The pin extracting device according to claim 2 wherein the impact force is applied by a handle comprising:

a shaft portion threaded into said housing;

a stop member attached at the distal end of said shaft portion;

a an impact member slidably mounted on said shaft portion between said housing and said stop member, whereby said impact member may be moved rapidly along said shaft portion and provide an extraction force when it impacts the stop member.

4. A pin extracting device comprising:

a housing, said housing having a central bore extending therethrough and a counterbore extending from one end nearly through said housing and concentric with said central bore, said central bore terminating in a pin-receiving opening at the other end of said housing;

a swaging body inserted in the counterbore of said housing, said swaging body having an angled slot extending along one surface thereof, one end of said slot being aligned with and adjacent to the pin receiving opening in said housing; and handle means inserted in said one end of said housing for activating said swaging body and for applying an extracting force to said pin.

5. A method of extracting a pin from a mechanical assembly comprising the steps of:

inserting the pin in a pin-receiving opening in one end of a housing member, said housing member having a counterbore at the other end thereof inserting a swaging body in the counter bore of said housing for receiving said pin in an angled slot therein deforming the pin with in the housing by activating said swaging member; and applying an extracting force to the housing.

6. The method according to claim 5 wherein the extraction force is an impact force.

7. The method according to claim 6 wherein the impact force is applied by a slap hammer.

* * * * *